US006395166B1

(12) United States Patent
Haydock

(10) Patent No.: US 6,395,166 B1
(45) Date of Patent: May 28, 2002

(54) METHOD OF RECLAIMING USED MOTOR OIL FOR FURTHER USE

(76) Inventor: Frederick J. Haydock, 6340 S. Castlefield La., Murray, UT (US) 84107

( * ) Notice: Subject to any disclaimer, the term of this patent is extended or adjusted under 35 U.S.C. 154(b) by 0 days.

(21) Appl. No.: 09/650,782

(22) Filed: Aug. 30, 2000

(51) Int. Cl.[7] ..... C10M 175/00
(52) U.S. Cl. ..... 208/179; 208/180; 208/181
(58) Field of Search ..... 208/179, 180, 208/181

(56) References Cited

U.S. PATENT DOCUMENTS

| | | | | | |
|---|---|---|---|---|---|
| 3,763,036 | A | * | 10/1973 | Jordan et al. | 208/180 |
| 4,021,333 | A | * | 5/1977 | Habiby et al. | 208/179 |
| 4,094,770 | A | * | 6/1978 | Bose | 208/251 R |
| 4,097,369 | A | * | 6/1978 | Ebel et al. | 208/180 |
| 4,154,670 | A | | 5/1979 | Forsberg | 208/180 |
| 4,399,025 | A | | 8/1983 | Fletcher et al. | 208/180 |
| 4,402,824 | A | | 9/1983 | Sunami et al. | 208/45 |
| 4,491,515 | A | | 1/1985 | Agnew et al. | 208/180 |
| 4,597,882 | A | * | 7/1986 | Nishimura et al. | 252/51 |
| 4,746,420 | A | | 5/1988 | Darian et al. | 208/222 |
| 4,888,108 | A | * | 12/1989 | Farnard | 208/424 |
| 5,141,628 | A | * | 8/1992 | Martin et al. | 208/184 |
| 5,238,591 | A | | 8/1993 | Flickinger | 252/52 R |
| 5,306,419 | A | * | 4/1994 | Harrison et al. | 208/179 |
| 5,353,760 | A | * | 10/1994 | Zager | 123/196 S |
| 6,174,431 | B1 | * | 1/2001 | Williams et al. | 208/183 |
| 6,214,236 | B1 | * | 4/2001 | Scalliet | 210/708 |

* cited by examiner

*Primary Examiner*—Nadine Preisch
(74) *Attorney, Agent, or Firm*—Thorpe North & Western, LLP

(57) ABSTRACT

A method of reclaiming used motor oil for further use is disclosed comprising (a) admixing used impurity laden motor oil with an effective amount of acetone as a flocculating agent and an effective amount of a second ketone as a wetting agent thereby forming an oil impurity flocculent mixture; (b) subjecting said mixture to a force such that a heavy phase and a light phase are formed, wherein said light phase is comprised of lean motor oil, acetone, and a second ketone, and wherein said heavy phase is comprised of flocculated impurities, any remaining acetone, and any remaining second ketone; and (c) separating said light phase containing said lean motor oil from said heavy phase containing said flocculated impurities. Preferably the second ketone is diisopropyl ketone, though other second ketones are also functional.

19 Claims, 1 Drawing Sheet

METHOD OF RECLAIMING USED MOTOR OIL FOR FURTHER USE

FIELD OF THE INVENTION

The present invention relates to compositions and methods for reclaiming used motor oils for further use.

BACKGROUND OF THE INVENTION

As a part of the regular maintenance typically required for internal combustion engines, such as automobiles, trucks, trains, airplanes, etc., the oil used for lubrication becomes contaminated and must be removed on a regular basis. After removal, the oil chamber is typically refilled with new oil. The reason that the used oil must be replaced is because lubrication oil used in-internal combustion engines readily become laced with contaminants including water, light hydrocarbons, oil oxidation products, suspended particulates, and other extraneous substances. These contamination components render the oils unsuitable for continued use. Though the used oil becomes contaminated as described, the oil itself is not consumed in the engine during the combustion process. As such, used oil or waste oil has recently been viewed as a valuable resource for reuse, assuming it could be reclaimed in a simple and efficient manner.

The particulates that end up in used lubrication oil usually consist of aggregates of carbonaceous material and compounds of lead produced in the combustion of leaded gasoline or other petroleum based fuels, as well as small quantities of metals resulting from the wear of pistons, cylinders, valves and other moving parts within the engine. In many cases, these particulates are small in size and are kept in suspension by dispersant compounds deliberately added for that purpose to fresh lubricating oil. Typically, the contaminants, depending upon the amount of use the oil has been exposed to, can comprise up to about 25% of the used oil volume.

Once the used oil has been drained from the engine, it may be disposed of by incineration, land fill deposit, or by other known disposal methods. Additionally, used oil is sometimes used in road oiling for dust control. With respect to used oil disposal, there are several reasons why such methods are undesirable. For example, used oil is a hazardous waste that can have an adverse effect on the environment. Even if it is incinerated or burned, it may put toxic materials into the air. Additionally, if used motor oil is not properly handled with respect to land fills, it can contaminate soil and eventually groundwater. Because of these and other environmental concerns, waste oil is sometimes stored in barrels or other containers, but this is a very expensive alternative. As these alternatives have both environmental and financial drawbacks, many have attempted and, to a limited extent, succeeded in developing approaches to re-refine used motor oil.

In many of the re-refining systems of the prior art, water and sediments are removed by the use of chemical emulsion breakers. Next, the acidic compounds in the oil are neutralized and then treated with additional caustics and acids to assist in the removing of the carbonaceous compounds created during the combustion process. The oil is then introduced into a distillation column for treatment with hydrogen to clarify and purify this material for use once again as a lubricating oil. Though this method is effective in treating used motor oil, the operating costs are relatively expensive and the initial investment to start such a facility are often prohibitively expensive.

In addition to the basic approach described above, many variations on this and other known approaches exist including solvent treatment, acid and alkali washing, and high-temperature distillation. For example, in U.S. Pat. No. 3,763,036, methyl ethyl ketone (MEK) has been shown to result in slow flocculation of particulates which may then be removed by gravity settling or by centrifugal separation. Additionally, in U.S. Pat. No. 3,639,229, a process is described where a mixture of an aliphatic monohydric alcohol of from four to five carbon atoms and a light hydrocarbon are added to waste oil. Once the mixture settles into three distinct layers, the upper oily layer is recovered, treated with sulfuric acid and thereafter refined by conventional methods. Additionally, in U.S. Pat. No. 3,919,076, a process is described that involves removing water and adding a saturated hydrocarbon solvent to the waste oil, settling the mixture to recover the oil/solvent mix, removing the solvent from the mixture, vacuum distilling the residual oil to collect selected fractions, hydrogenating the fractions in the presence of a catalyst, stripping hydrogenated oil to remove light ends, and filtering the remaining products. U.S. Pat. No. 4,124,492 discloses a process for reclaiming useful hydrocarbon oil from contaminated waste oil. In that process, the waste oil is dehydrated and then dissolved in selected amounts of isopropanol. The undissolved waste matter is separated and the residual oil/solvent fraction is distilled to recover the decontaminated oil and solvent. A bleaching clay or activated carbon at elevated temperatures is then used to further process the oil.

Though some of these methods of reclaiming used oil have proven to be useful in their own right, it would be useful to provide an alternative method of reclaiming used motor oil that is simple, effective, and economical to practice.

SUMMARY OF THE INVENTION

A composition and method of reclaiming used motor oil for further use is disclosed comprising admixing used impurity laden motor oil with an effective amount of acetone as a flocculating agent and an effective amount of a second ketone as a wetting agent, thereby forming an oil impurity flocculent mixture. The mixture is then subjected to a force such that a heavy phase and a light phase are formed. The light phase is comprised of lean or purified motor oil, acetone, and a second ketone. The heavy phase is comprised of flocculated impurities (at least some of which can be resuspended as part of the heavy phase), any remaining acetone, and any remaining second ketone. The light phase containing the lean motor oil is then separated from the heavy phase containing the flocculated impurities. The lean oil can then be separated from the acetone and the second ketone, usually by a vapor recovery process.

DESCRIPTION OF THE DRAWINGS

A more complete understanding of the invention will be readily appreciated by reference to the following detailed description when considered in conjunction with the accompanying figure.

DETAILED DESCRIPTION OF THE INVENTION

Figure 1:
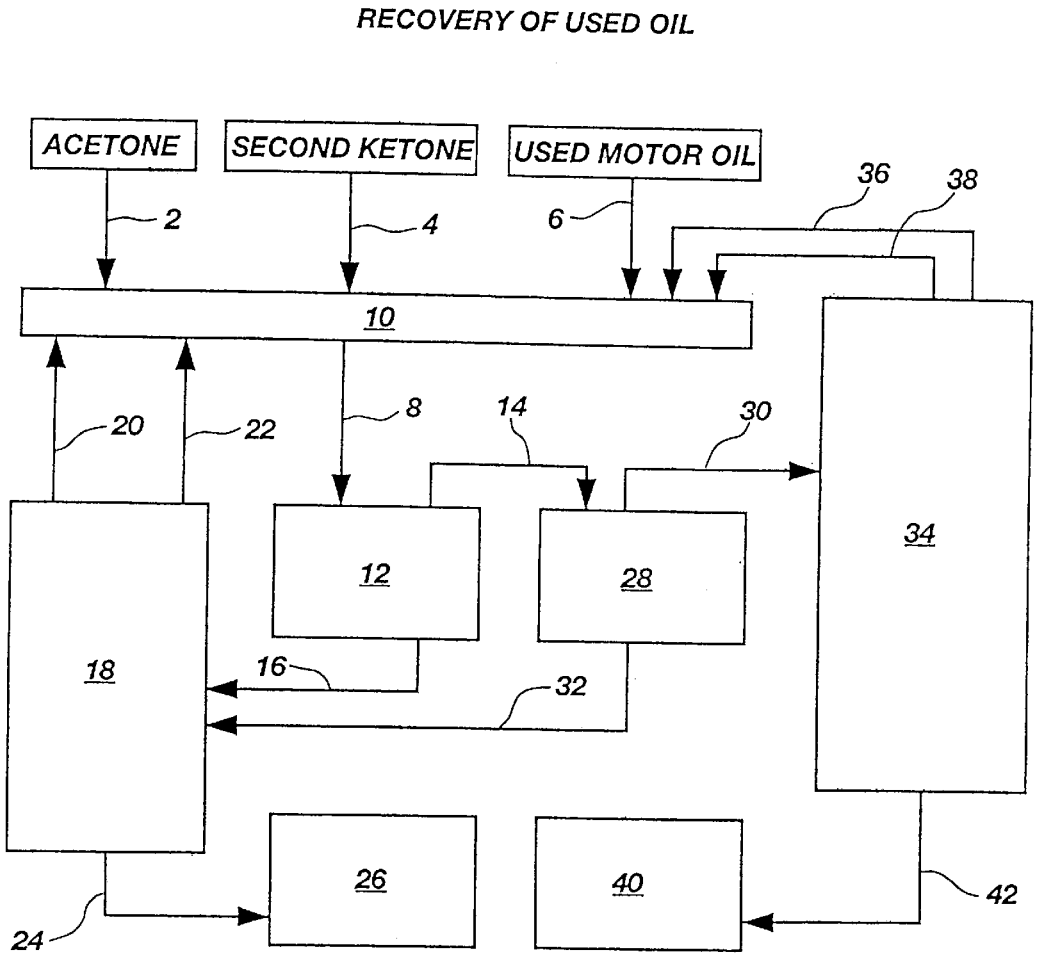
FIG. 1 is a flow diagram illustrating a preferred embodiment of the present invention.

Before the present invention is disclosed and described, it is to be understood that this invention is not limited to the particular process steps and materials disclosed herein as such process steps and materials may vary to some degree. It is also to be understood that the terminology used herein is used for the purpose of describing particular embodiments only and is not intended to be limiting as the scope of the present invention will be limited only by the appended claims and equivalents thereof.

Referring to FIG. 1, a flow diagram is shown wherein acetone, a second ketone, and used motor oil are passed, in effective amounts, through lines 2, 4, and 6, respectively into a blending/mixing vessel 10 where they are thoroughly intermixed. Though not shown, a high speed mixing unit may be used for convenience, though mixing may occur by any suitable means in the blending/mixing vessel 10 or other holding tank. Once these ingredients are sufficiently blended or mixed, flocculation and some phase separation begins to occur with the flocculant being concentrated in the heavy phase. Particularly in the heavy phase, some or all of the flocculent may resuspend in that phase. The mixture is then passed through line 8 into a decanting centrifuge 12 and subjected to a force such that a heavy phase and a light phase continue to form. The separation into phases may occur simply by means of gravity as would be used in conjunction with a settling tank. However, as shown in FIG. 1, the force exerted on the mixture is preferably provided by a decanting centrifuge 12. After forming two phases, the light phase containing lighter fractions of oil, acetone, and second ketone is withdrawn from centrifuge 12 through line 14 and the heavy phase containing heavier fractions of oil, floccculent, any remaining acetone, and any remaining second ketone is withdrawn from centrifuge 12 through line 16. Line 16 transports the heavy phase/flocculent to a heavy phase additive re-claimer 18 where the additives (acetone and the second ketone) are removed from is the impurities and recycled via lines 20 and 22 respectively into the blending/mixing vessel 10 for further use. Additionally, the impurities are sent via line 24 to a heavy impurity collection tank 26. In other words, the purpose of the heavy phase additive re-claimer 18 is to separate any oil fractions and impurities from the additives such that the additives may be reused and the impurities be removed. This can be accomplished by distillation and/or vapor recovery at from room temperature to about 95° C. However, temperatures from about 50° C. to 95° C. are more preferred, and temperatures from about 50° C. to 95° C. are most preferred such that the acetone and second ketone can be essentially distilled off in a reasonable amount of time. Additionally, the additives can also be removed with the aid of a vacuum under certain circumstances. For example, at higher temperatures, a vacuum can be used to remove the acetone and the second ketone in an efficient manner.

The light phase containing a reclaimed oil along with some acetone and some second ketone can be sent directly to a light phase additive re-claimer 34 for acetone and second ketone removal. However, as shown in FIG. 1, the light phase is preferably first sent through line 14 to a clarifying centrifuge 28 for further separation and purification to remove any residual heavy phase material that might not have been separated from the decanting centrifuge 12. From the clarifying centrifuge 28, the residual heavy phase containing flocculated impurities is sent, via line 32, to the heavy phase additive re-claimer 18 and the light phase is then sent by means of line 30 to a light phase additive re-claimer 34. In either additive re-claimer, i.e., light phase additive reclaimer 34 and heavy phase additive reclaimer 18, any remaining acetone or second ketone is substantially removed and can be introduced back to the blending/mixing vessel 10 by vapor recovery as previously described or by other known methods. The light phase additive reclaimer 34 allows for reintroduction of the acetone and the second ketone to the blending/mixing vessel 10 via lines 36 and 38 respectively. Additionally, from the light phase additive reclaimer 34, the reclaimed oil can then be sent to a vessel or collection tank 40 via line 42. The reclaimed oil is then in a condition to be mixed with lighter fractions for use as a marine grade diesel fuel.

With the preferred embodiment described herein in mind, a composition and method of reclaiming used motor oil for further use is disclosed. The method producing the composition comprises the steps of admixing used impurity laden motor oil with an effective amount of acetone as a flocculating agent and an effective amount of a second ketone as a wetting agent, thereby forming an oil impurity flocculent mixture; subjecting the mixture to a force such that a heavy phase and a light phase are formed, wherein the light phase is comprised of lean motor oil, acetone, and a second ketone, and wherein the heavy phase is comprised of flocculated impurities, any remaining acetone, and any remaining second ketone; and separating the light phase containing the lean motor oil from the heavy phase containing the flocculated impurities. In many cases, the flocculent impurities are resuspended in the heavy phase. Though acetone is a required reactant for use as the flocculating agent, the second ketone may be one of a number of ketones. Specifically, the second ketone can be defined by formula 1 below:

FORMULA 1

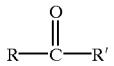

wherein R is a member selected from the group consisting of $C_1$ to $C_6$ straight chain alkyl, $C_3$ to $C_6$ branched chain alkyl, and aromatic, and R' is a member selected from the group consisting of $C_2$ to $C_6$ straight chain alkyl, $C_3$ to $C_6$ branched chain alkyl, and aromatic. Though the structures describe in Formula 1 encompass several ketones, di-isopropyl ketone (DIPK) is the most preferred second ketone that can be used. To illustrate possible structures that fall under Formula 1, other second ketones that can be used include methyl isopropyl ketone (MIPK), methyl isobutyl ketone (MIBK), methyl ethyl ketone (MEK), benzyl methyl ketone, acetophenone, benzophenone, methyl n-propyl ketone, n-butyrophenone, and diethyl ketone.

Once the light phase is separated from the heavy phase and impurities, it is preferred that the light phase be further processed to remove the additives, i.e., acetone and/or second ketone. An additive reclaimer, such as a vapor recovery system, to remove sufficient amounts of the acetone and the second ketone can be used to provide a lean reclaimed oil essentially free of additives. If a vapor recovery system is used to reclaim the additives, distillation at temperatures from 50° C. to 95° C. are preferred, though the additives can be reclaimed at room temperature over a greater amount of time. Once essentially all of the acetone and the second ketone (as well as impurities and heavy fractions from previous steps) are substantially removed from the lean motor oil, the lean oil can effectively be mixed with lighter fractions such as fuel grade hydrocarbons to form marine grade diesel fuel.

One primary purpose for adding acetone and a secondary ketone to the used oil is to flocculate and remove sediment and other impurities from the oil. In general, ketones are similar to lubricating oils in specific gravity, but have significant solubility differences. Specifically, oil is hydrophobic and ketones (both acetone and the secondary ketone) are polar solvents, and thus, are more hydrophilic.

When the acetone and the second ketone are thoroughly mixed with the used oil, a miscible mixture is formed. In that state, sediment and other impurities (including detergents, pressure agents, etc., contained in the oil) can flocculate or coagulate. For example, in the case where diisopropyl ketone and acetone are used, the diisopropyl ketone acts as the solubilizer of the oil and the acetone acts to change the polarity of the mixture, thus, causing the impurities to separate from the oil mixture. Because these flocculants are generally heavier than the acetone, the second ketone, and the oil, the flocculants can drop to the bottom of the mixture upon standing or upon centrifuging. Thus, due to the polarity difference, a lean oil remains in a first phase (having most of the acetone and the second ketone contained therein) and the impurities remain in a second phase. The second phase generally has a greater density than the first phase, and hence, the second phase is forced to the bottom of the container to join with the sediment. With regard to the first or light phase, the lean oil and the acetone are both solubilized in the diisopropyl ketone. Thus, in one embodiment, the acetone can be distilled off first and the diisopropyl ketone can then be distilled off at generally higher temperatures such as from about 75° C. to 95° C. Once the acetone and the second ketone are distilled off, a relatively impurity free motor oil remains.

As stated, it is preferred that the reclaimed lean motor oil be separated from the acetone and second ketone for further use. However, the acetone and the second ketone need not be discarded once removed from the lean motor oil. If properly separated, any acetone and any second ketone removed from the lean oil can be recycled back into a mixing, blending, or holding vessel where the used oil, acetone, and the second ketone were initially mixed. Additionally, the heavy phase and impurities which are separated out from the desired light phase lean oil will also have reusable amounts of acetone and second ketone present as well. For example, after the heavy phase and impurities are separated from the light phase by a force, the heavy phase and impurities can also be further processed to remove any acetone and second ketone present to be recycled back into the initial mixing, blending, or holding vessel. Once the acetone and the second ketone are removed, a heavy impurity containing sediment remains.

The force described in the present composition and method which is used to separate the light phase from the heavy phase and impurities can be any force known by those skilled in the art. For example, gravity may be used as the force exerted on the mixture, e.g., a settling tank. Centrifuges of various types which provide various spin parameters may also be used. In a preferred embodiment, the force is centrifugal wherein multiple centrifuges or centrifuge settings are used. For example, a decanting centrifuge which acts to substantially separate the phases can be used, followed by a clarifying centrifuge to further clarify the light phase. Additionally, the light phase may be separated from the heavy phase by decanting the light phase.

When determining the appropriate amount of flocculating agent, i.e. acetone, and wetting agent or solubilizer, i.e. second ketone, to add to the used motor oil, functional considerations can be applied, though certain ranges are considered to be preferred. For example, the acetone to impurity laden oil can be from about 1:1 to 25:1 by weight. Additionally, the second ketone to impurity laden oil can be from about 1:1 to 20:1 by weight. These ranges are provide to show preferred ranges and should in no way limit the scope of the present invention.

EXAMPLES

The following examples illustrate the preferred embodiments of the invention that are presently best known. However, other embodiments may be practiced which are also within the scope of the present invention.

Example 1

To 1 gram (4.762% by weight) of used motor oil was mixed 10 grams (47.62% by weight) of diisopropyl ketone and 10 grams (47.62% by weight) of acetone. After mixing the initial ingredients, carbonaceous material, i.e., bottoms, and sediment separated and dropped to the bottom of the flask effectively without centrifuging. The carbonaceous materials and sediment are then resuspended to form a heavy phase. The light phase (having some acetone and diisopropyl ketone therein) appeared amber in color. Though significant separation occurred without centrifugation, the mixture was centrifuged in an 800 G centrifuge for 2 minutes. Some additional separation between the light phase and heavy phase was observed.

Example 2

A mixture of 1 gram (1.96% by weight) of used motor oil, 20.0 grams (39.22% by weight) of diisopropyl ketone, and 30.0 grams (58.82% by weight) of acetone was prepared. Carbonaceous material and sediment separated out, dropped in the flask, and resuspended to form a heavy phase. A light phase formed comprised of lighter fractions of oil, some acetone, and some diisopropyl ketone which was light amber in color prior to centrifuging. Once centrifuged at 800 G for 2 minutes, suspended sediment and carbonaceous materials continued to separate, drop to the bottom of the container, and resuspend in the heavy phase. The light phase was very light amber color.

Example 3

To 1 gram (9.1% by weight) of used motor oil was mixed 5 grams (45.45% by weight) of diisopropyl ketone and 5 grams (45.45% by weight) of acetone in a flask. Again, carbonaceous materials, i.e., bottoms, and sediment separated and dropped in the oil to the flask bottom effectively without centrifuging, leaving a light phase which was dark amber in color. Some of the heavy carbonaceous materials and sediment was resuspended, particularly in the heavy phase. After centrifuging the mixture in a centrifuge at 800 G for 2 minutes, the sediment and carbonaceous portion was further separated from the light phase leaving a light phase comprised of lighter fractions, some acetone, and some diisopropyl ketone having a dark amber color.

Example 4

A mixture of 1 gram (20% by weight) of used motor oil, 2 grams (40% by weight) of diisopropyl ketone, and 2 grams (40% by weight) of acetone was prepared in a flask. Carbonaceous material, i.e., bottoms, and sediment separated and dropped to the flask and then was resuspended as part of a heavy phase. A light phase remained which appeared dark amber in color. This mixture was then centrifuged in a centrifuge at 800 G for 2 minutes where more sediment dropped and resuspended. The remaining light phase containing the additives was dark amber in color.

Example 5

To 2.5 grams (50% by weight) of used motor oil was mixed 1.25 grams (25% by weight) of diisopropyl ketone and 1.25 grams (25% by weight) of acetone. Carbonaceous materials and sediment separated and dropped to the bottom of the flask slowly becoming part of a heavy phase. A lighter phase formed above the heavy phase which was a very dark, almost burgundy color. After centrifugation at 800 G for 2 minutes, more of the carbonaceous portion dropped and resuspended in the heavy phase. The lighter phase lightened in color some, but was still a very dark color.

Example 6

A mixture of 3.5 grams (70% by weight) of used motor oil, 0.75 grams (15% by weight) of diisopropyl ketone, and 0.75 grams (15% by weight) of acetone was prepared in a flask. The heavy bottoms and carbon compounds began to drop to the bottom of the flask, but the lighter phase which remained was extremely dark in color. Prior to centrifuging the mixture, the material at the bottom of the flask had a heavy thick appearance. The above mixture was then centrifuged in a centrifuge 800 G for 2 minutes. The sediment and carbonaceous portion was observed and the lighter phase, though dark in color, still had some transparency.

Example 7

To about 1.00 gram (4.762% by weight) of used motor oil was mixed 10.0 grams (47.62% by weight) of methel ethyl ketone and 10.0 grams (47.62% by weight) of acetone. Though some separation occurred, the carbonaceous material and sediment did not separate from the used oil as effectively as in the Examples having similar amounts of diisopropyl ketone. As such, the lighter phase remained dark in color.

Example 8

A mixture of 1 gram (4.762% by weight) of used motor oil, 10 grams (47.62% by weight) of methylisopropyl ketone, and 10.0 grams (47.62% by weight) of acetone was prepared in a flask. Carbonaceous material, i.e., bottoms, and sediment separated to some degree from the oil. After mixing, the phase separation was not as clear that found in Examples 1 to 5. However, after separation, the lighter phase was lighter in color.

Example 9

A mixture of 1 gram (4.762% by weight) of used motor oil, 10 grams (47.62% by weight) of methylisobutyl ketone, and 10 grams (47.62% by weight) of acetone was prepared. Carbonaceous material and sediment formed, but not as effectively as those found in Examples 1 to 5 and 8. Though some separation did occur, the solution was dark in appearance indicating that motor oil fractions had not been significantly solubilized.

Example 10

To 1 gram (4.762% by weight) of used motor oil was mixed 10 grams (47.62% by weight) of diisopropyl ketone and 10 grams (47.62% by weight) of methyl ethyl ketone. No Acetone was added. Carbonaceous material, bottoms, and sediment did not separate effectively, particularly as when compared to the solutions and formulations containing the Acetone and diisopropyl ketone. Additionally, flocculation did not appear to occur as readily or as effectively as the above formulations using acetone. Thus, no appreciable phase separation occurred.

Example 11

To 1 gram (4.762% by weight) of used motor oil was mixed 10 grams (47.62% by weight) of diisopropyl ketone and 10 grams (47.62% by weight) of methylisobutyl ketone. Again, no Acetone was added. Carbonaceous material and sediment did not separate effectively and flocculation did not take place as the formulation containing acetone.

As demonstrated by the examples, by mixing effective amounts of acetone with a second ketone, particulates and impurities begin to settle out and resuspend with large amounts of the acetone and second ketone to form a heavy phase. Centrifugation acts to assist the separation such that the separation occurs more quickly, but is not necessarily required to practice the invention. When the second ketone is diisopropyl ketone, the method is particularly effective, even when low amounts diisopropyl ketone and acetone are used. See Examples 1–6. Additionally, when acetone was not used, separations were not effective. See Examples 10 and 11. Therefore, by using acetone and diisopropyl ketone together, good results are achieved. However, by using acetone and a different second ketone other than diisopropyl ketone, acceptable results can also be achieved. See Examples 6–9.

Example 12

The light phase in Example 2 was decanted from the heavy phase by conventional methods and then separated from substantially all of the acetone and diisopropyl ketone dispersed therein. The acetone and diisopropyl ketone was removed by a distillation process, i.e., vapor recovery, wherein the light phase containing light fractions, some acetone, and some diisopropyl ketone was boiled to about 75° C. for about 15 minutes. Once substantially all of the acetone and diisopropyl ketone were removed, a recovered oil product remained which can be mixed with lighter fractions for use as marine grade diesel fuel.

While the invention has been described with reference to certain preferred embodiments, those skilled in the art will appreciate that various modifications, changes, omissions, and substitutions can be made without departing from the spirit of the invention. It is therefore intended that the invention be limited only by the scope of the appended claims.

What is claimed is:

1. A method of reclaiming used motor oil for further use comprising:

a) admixing used impurity laden motor oil with an effective amount of acetone as a flocculating agent and an effective amount of di-isopropyl ketone (DIPK) as a wetting agent, thereby forming an oil flocculent mixture;

b) subjecting said mixture to a force such that a heavy phase and a light phase are formed, wherein said light phase is comprised of lean motor oil, acetone, and di-isopropyl ketone (DIPK), and wherein said heavy phase is comprised of flocculated impurities, any remaining acetone, and any remaining di-isopropyl ketone (DIPK); and c) separating said light phase from said heavy phase.

2. A method according to claim 1 comprising processing said light phase to remove substantially all of said acetone and said di-isopropyl ketone (DIPK).

3. A method according to claim 2 comprising recovering a reclaimed motor oil substantially free of impurities.

4. A method according to claim 2 wherein removed amounts of said acetone and said di-isopropyl ketone (DIPK) are recycled for use in step a) of claim 1.

5. A method according to claim 3 wherein said reclaimed motor oil is blended with an effective amount of fuel grade hydrocarbons to obtain a marine grade diesel fuel.

6. A method according to claim 1 wherein said heavy phase is further processed to substantially remove said remaining acetone and said remaining di-isopropyl ketone (DIPK), thereby recovering a heavy impurity containing sediment.

7. A method according to claim 6 wherein removed amounts of said remaining acetone and said remaining di-isopropyl ketone (DIPK) are recycled for use in step a) of claim 1.

8. A method according to claim 1 wherein the force is gravity.

9. A method according to claim 1 wherein the force is centrifugal.

10. A method according to claim 1 wherein the force is exerted by a decanting centrifuge.

11. A method according to claim 1 wherein said light phase is separated from said heavy phase by decanting.

12. A method according to claim 9 wherein said force is exerted by a clarifying centrifuge.

13. A method according to claim 1 wherein said acetone to said impurity laden oil are present at from about 1:1 to 25:1 by weight.

14. A method according to claim 1 wherein said di-isopropyl ketone (DIPK) to said impurity laden oil are present at from about 1:1 to 20:1 by weight.

15. A method according to claim 2 wherein said step of processing is accomplished by vapor recovery.

16. A method according to claim 15 wherein the vapor recovery is accomplished by distillation at from about 50° C. to 95° C.

17. A method according to claim 15 wherein the vapor recovery is accomplished at room temperature.

18. A method of reclaiming used motor oil for further use comprising:

a) admixing used impurity laden motor oil with an effective amount of acetone as a flocculating agent and an effective amount of a second ketone as a wetting agent, said second ketone containing at least one propyl group attached to the carbonyl carbon, thereby forming an oil impurity flocculent mixture;

b) subjecting said mixture to a force such that a heavy phase and a light phase are formed, wherein said light phase is comprised of lean motor oil, an amount of acetone, and an amount of the second ketone, and wherein said heavy phase is comprised of flocculated impurities, any remaining acetone, and any remaining second ketone; and c) separating said light phase containing said lean motor oil from said heavy phase containing said flocculated impurities.

19. A method according to claim 18 wherein said propyl group is an isopropyl group.

* * * * *